US006648344B2

(12) United States Patent
Grande

(10) Patent No.: US 6,648,344 B2
(45) **Date of Patent: *Nov. 18, 2003**

(54) FOAM CORE IN-LINE SKATE FRAME

(75) Inventor: Dodd H. Grande, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/157,385

(22) Filed: May 28, 2002

(65) Prior Publication Data

US 2002/0140187 A1 Oct. 3, 2002

Related U.S. Application Data

(63) Continuation of application No. 09/199,398, filed on Nov. 24, 1998, now Pat. No. 6,422,577.

(51) Int. Cl.[7] ..... A63C 17/06

(52) U.S. Cl. ..... 280/11.221; 280/11.225; 280/11.231

(58) Field of Search ..... 280/11.221, 11.231, 280/11.27, 11.19, 11.28, 11.25, 11.227, 11.225

(56) References Cited

U.S. PATENT DOCUMENTS

| | | | | |
|---|---|---|---|---|
| 109,026 A | | 11/1870 | Leak | |
| 110,858 A | | 1/1871 | Kimball | |
| 2,644,692 A | | 7/1953 | Kahlert | |
| 3,351,353 A | | 11/1967 | Weitzner | |
| 4,909,523 A | | 3/1990 | Olson | |
| 4,932,675 A | | 6/1990 | Olson et al. | |
| 5,046,746 A | | 9/1991 | Gierveld | |
| 5,092,614 A | | 3/1992 | Malewicz | |
| 5,314,199 A | | 5/1994 | Olson et al. | |
| 5,340,132 A | | 8/1994 | Malewicz | |
| 5,346,231 A | | 9/1994 | Ho | |
| 5,380,020 A | | 1/1995 | Arney et al. | |
| 5,385,356 A | | 1/1995 | Conte | |
| 5,388,846 A | | 2/1995 | Gierveld | |
| 5,397,141 A | | 3/1995 | Hoshizaki et al. | |
| 5,413,380 A | * | 5/1995 | Fernandez | 280/11.19 |
| 5,462,295 A | | 10/1995 | Seltzer | |
| 5,513,861 A | | 5/1996 | Monroy et al. | |
| 5,533,740 A | | 7/1996 | Lin | |
| 5,549,309 A | | 8/1996 | Gleichmann | |
| 5,560,625 A | | 10/1996 | Kuykendall | |
| 5,586,777 A | | 12/1996 | Wolf | |
| 5,599,036 A | | 2/1997 | Abondance et al. | |
| 5,704,620 A | | 1/1998 | Oliemans et al. | |
| 5,732,958 A | | 3/1998 | Liu | |
| 5,816,588 A | | 10/1998 | Nicoletti | |
| 5,934,692 A | | 8/1999 | Artus | |
| 5,934,693 A | | 8/1999 | Nicoletti | |
| 5,951,027 A | * | 9/1999 | Oyen et al. | 280/11.208 |
| 6,189,898 B1 | | 2/2001 | Benoit | |
| 6,328,317 B1 | * | 12/2001 | Benoit | 280/11.221 |
| 6,345,827 B1 | * | 2/2002 | Benoit | 280/11.221 |
| 6,422,577 B2 | * | 7/2002 | Grande | 280/11.221 |

FOREIGN PATENT DOCUMENTS

| | | |
|---|---|---|
| EP | 0 321 026 A3 | 6/1989 |
| WO | WO 98/02217 | 1/1998 |

* cited by examiner

*Primary Examiner*—Brian L. Johnson
*Assistant Examiner*—Hau Phan
(74) *Attorney, Agent, or Firm*—Christensen O'Connor Johnson Kindness

(57) ABSTRACT

A skate frame (20) for an in-line skate (18) having a shoe portion (22) and a plurality of wheels (24) capable of traversing a surface. The skate frame includes an elongate structural member comprised of a structural material having a first average density. The structural member having first and second sidewalls (62 and 68), each having an upper end and a lower end. The structural member also includes a shoe mounting portion (50) spanning between at least a portion of the upper ends of the sidewalls. The first and second sidewalls having a wheel load introduction portion (58), wherein loads associated with the wheels are transferred to the structural member. The shoe mounting portion having a shoe load introduction portion, wherein loads associated with the shoe portion are transferred to the structural member.

4 Claims, 6 Drawing Sheets

Fig. 7.
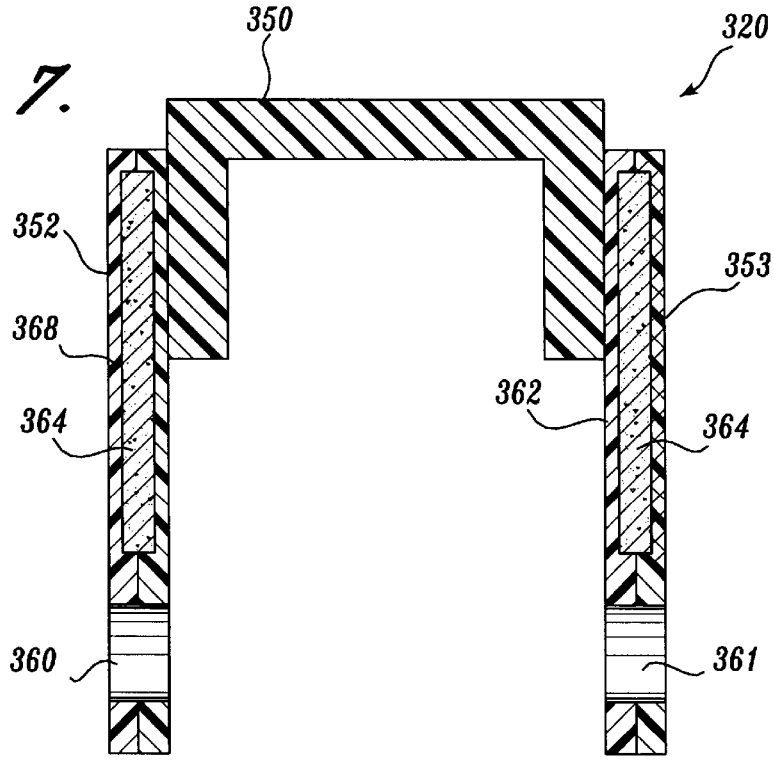
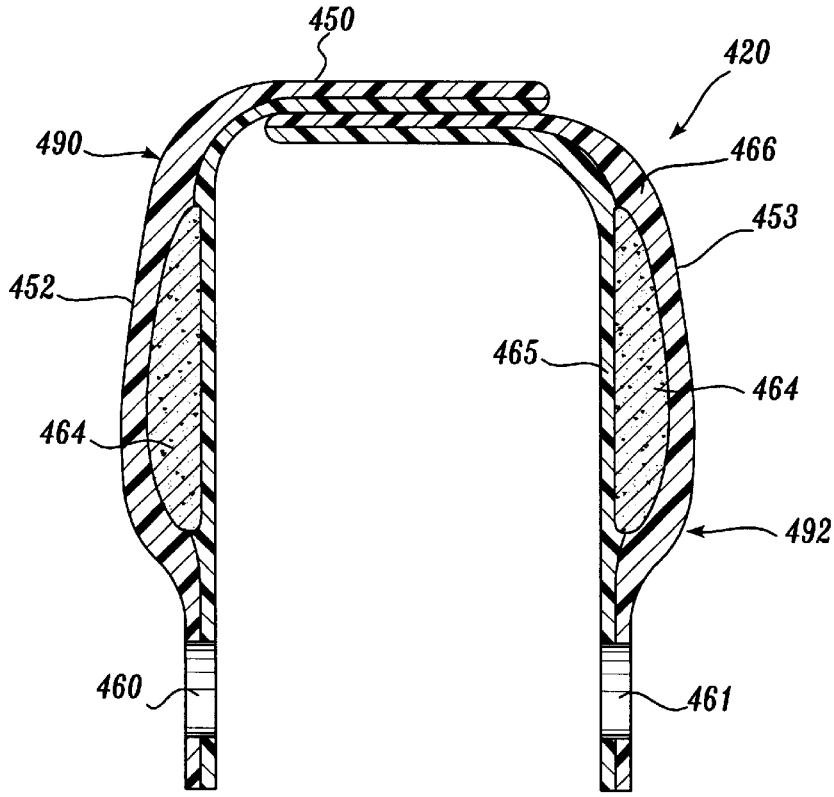
Fig. 8.

FOAM CORE IN-LINE SKATE FRAME

CROSS-REFERENCE TO RELATED APPLICATION

This application is a continuation application of application Ser. No. 09/199,398, filed Nov. 24, 1998, now U.S. Pat. No. 6,422,577, priority from the filing date of which is hereby claimed under 35 U.S.C. §120 and the disclosure of which is hereby expressly incorporated by reference.

FIELD OF THE INVENTION

The present invention relates generally to skates and, in particular, to a skate frame having a core of lightweight material to increase structural strength-to-weight and stiffness-to-weight ratio of the frame.

BACKGROUND OF THE INVENTION

In-line roller skates generally include an upper shoe portion having a base secured to a frame that carries a plurality of longitudinally aligned wheels. The upper shoe portion provides the support for the skater's foot, while the frame attaches the wheels to the upper shoe portion. Because in-line skates are designed to accommodate a variety of skating styles, including high-performance competitions, it is desirable for such skate frames to be lightweight, stiff, and strong. Skate frames may be constructed from a variety of materials, including aluminum, injection molded plastic and composites. Although aluminum skate frames are structurally strong and stiff, they are expensive. Skate frames constructed from an injection molded plastic are often reinforced with short, discontinuous fibers. Although such skate frames are lower in cost than aluminum frames, they lack the specific strength and stiffness performance characteristics associated with continuous fiber-reinforced composite frames.

Currently, fibers of glass or carbon are preferred to reinforce composite frames. Glass reinforced composite skate frames are both structurally stiff and strong, but they are heavier than composite frames reinforced with carbon fibers. Although carbon fiber reinforced skate frames are lightweight, strong, and stiff, they are expensive.

Frames constructed from composites reinforced with glass, carbon fibers, or other high performance fibers may be improved by sandwiching a core material between face sheets or skins of reinforced composite material. The core is a lighter, less expensive material with moderate structural properties in terms of strength and stiffness.

Prior in-line skate frames having a core construction include inverted U-shaped skate frames having a polymer core bonded within the concave portion of the skate frame. In such skate frames, the core is positioned between the frame's arcuate portion and the wheels. Although such skate frames provide increased structural stiffness, the core is subjected to accelerated wear and damage because it is exposed directly to the wheels and road debris. Therefore, such a skate frame may have a shortened useful life.

Other attempts of providing an in-line skate frame with a core include inverted U-shaped skate frames with core material sandwiched between two composite face sheets. In this type of frame, the core extends from below the wheel attachment points upwardly and across the upper surface of the frame. The wheels and shoe portion of the skate are attached to the frame by drilling or molding their respective attachment points through the sandwich construction, thereby subjecting the core material directly to the loads of both the wheel axle and shoe portion attachment bolts. This construction is undesirable because the core material is in direct contact with the wheel and shoe attachment hardware and, therefore, is susceptible to breakage.

Still other attempts of providing in-line skate frames with a core have included a core inserted within the junction between the sole of the shoe portion and the skate frame. Such skate frames have a flange extending laterally from both sides of the upper end of the skate frame, such that the lateral and medial sides of the upper surface span outwardly to cup the sole of the shoe portion therein. The interior of the flange portion is filled with a core material to absorb a portion of the loads associated with traversing a surface. The location of the flanges relative to the frame is custom made to accommodate a particular skater's foot and shoe width. Because the flange portion is sized to cup a specific shoe width, there is limited adjustment of the location of the shoe portion relative to the frame. Therefore, such a skate frame is not very robust in accommodating different skating styles, even for the skater for whom the skate was custom made. Moreover, because the skate is custom made and designed for a particular skater, it is expensive to manufacture.

Thus, there exists a need for a composite in-line skate frame having a lightweight core that not only maintains the frame's strength and stiffness, but also is economical to manufacture and meets the performance expectations of a skater.

SUMMARY OF THE INVENTION

The present invention provides a method of constructing a skate frame. The method includes the steps of forming a U-shaped first skin and positioning core material at a predetermined location on the first skin. The method further includes the step of forming a U-shaped second skin over the first skin, such that the core material is positioned and sealed between the first and second skins. A plug of filler material is disposed between the first and second skins to absorb at least a portion of the loads associated with at least the wheels or shoe portion of the skate. Finally, the method includes the step of curing the frame.

The method of constructing a skate frame of the present invention provides several advantages over skate frames currently available in the art. The skate frame of the present invention is lighter than solid composite or aluminum frames because a lightweight core material occupies a substantial volume within the frame. Also, because the core material is lightweight and provides a distance of separation between the skins of the sidewall, the strength-to-weight ratio of the frame is increased. Further, because the skate frame utilizes a core material that is less expensive than the reinforced composite material it replaces, it is more cost efficient than skate frames having an all composite construction. Finally, because the core material is removed from the load introduction points associated with the wheels and shoe portion, the skate frame has a longer useful life than skate frames having a core that is in direct contact with the load introduction points. Thus, a skate frame constructed in accordance with the present invention has an increased strength-to-weight ratio and is less expensive than those currently available in the art.

BRIEF DESCRIPTION OF THE DRAWINGS

The foregoing aspects and many of the attendant advantages of this invention will become better understood by reference to the following detailed description, when taken in conjunction with the accompanying drawings, wherein:

FIG. 7 is a cross-sectional end view of a fourth alternate embodiment of an in-line skate frame constructed in accordance with the present invention showing a three piece frame and core material disposed within the sidewalls of the frame;

FIG. 8 is a cross-sectional end view of a fifth alternate embodiment of a two-piece in-line skate frame constructed in accordance with the present invention showing core material disposed within the sidewalls of the skate frame.

DETAILED DESCRIPTION OF THE PREFERRED EMBODIMENT

Figure 1:
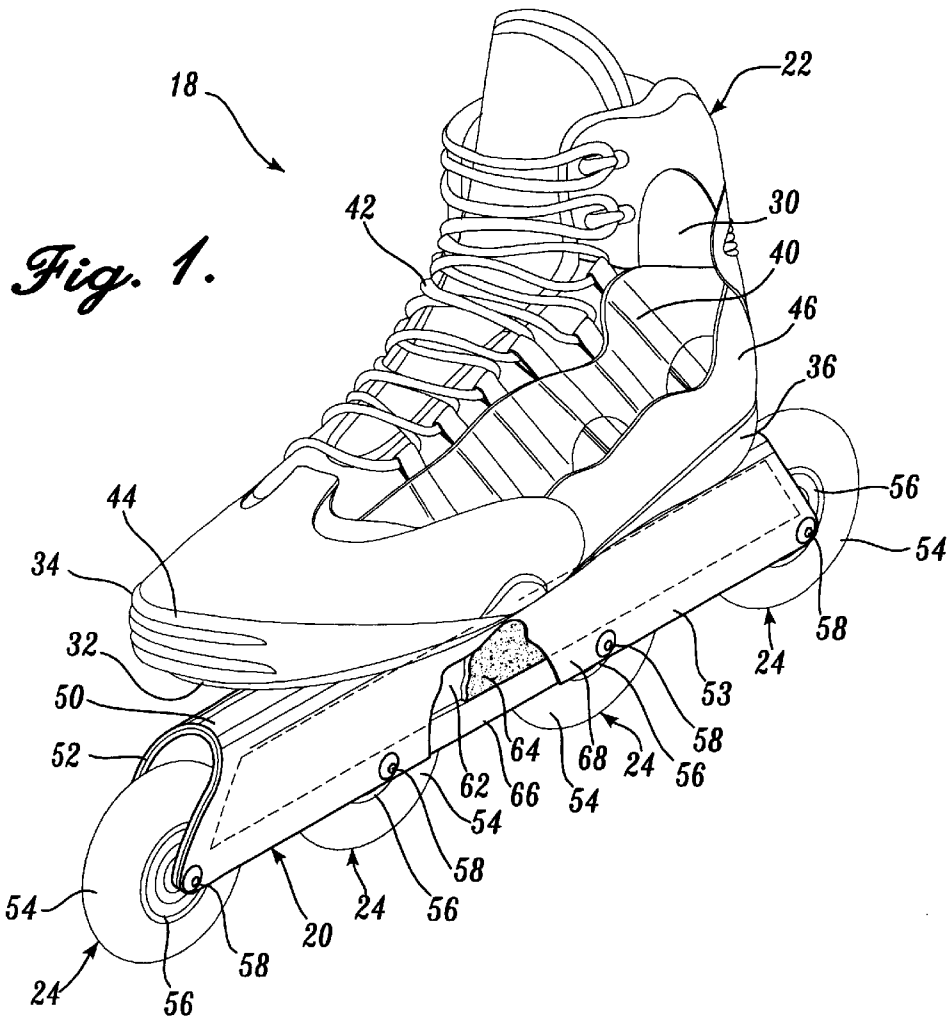
FIG. 1 is an environmental view of an in-line skate frame constructed in accordance with the present invention having a portion of the skate frame cut away to show the inner skin, core material, filler material, and outer skin.

FIG. 1 illustrates a preferred embodiment of an in-line skate 18 having a skate frame 20 constructed in accordance with the present invention. The skate frame 20 is shown attached to a shoe portion 22 and a bearing member in the form of a plurality of wheels 24.

The shoe portion 22 has an upper portion 30 and a base 32. The upper shoe portion 30 is preferably constructed from a flexible and durable natural or man-made material, such as leather, nylon fabric, or canvas. The upper shoe portion 30 also includes a conventional vamp 40 and vamp closure, including a lace 42, extending along the top of the foot from the toe area of the foot to the base of the shin of the skater. Preferably, the upper shoe portion 30 is fixedly attached to the base 32 by being secured beneath a last board (not shown) by means well known in the art, such as adhesive, riveting, or stitching. Alternatively, any skate footwear may be used with frame of present invention.

The base 32 is constructed in a manner well-known in the art from a resilient composite polymeric or natural material. The base 32 includes a toe end 34, a heel end 36, and a toe cap 44. Suitable materials for the base 32 include semi-rigid thermoplastic or thermosetting resins, which may be reinforced with structural fibers, such as carbon reinforced epoxy, or other materials, such as leather, wood, or metal. The toe cap 44 surrounds the toe end of the upper shoe portion 30 and is suitably bonded to the base 32. Alternatively, the toe cap 44 may not be used or may be formed of a different material from the rest of the base 32, such as rubber. Because the upper shoe portion 30 is preferably constructed from nylon or other flexible, natural, or man-made materials, the function of the toe cap 44 is to protect the toe end of the upper shoe portion 30 from impact, wear, and water. The toe cap 44 also extends around the lateral and medial sides of the toe end of the upper shoe portion 30 to provide additional support to the foot of the skater.

Figure 2:
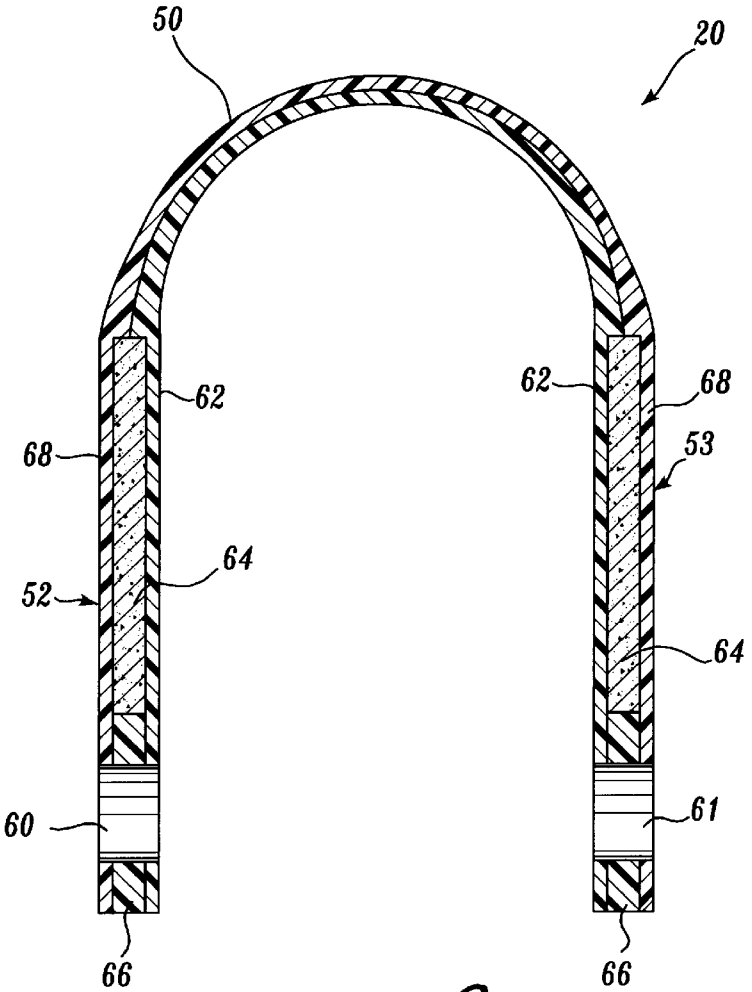
FIG. 2 is a cross-sectional end view through an in-line skate frame constructed in accordance with the present invention showing the core material disposed between the inner and outer skins of the sidewalls and a plug of filler material disposed around the wheel attachment bores.

Referring to FIGS. 1 and 2, attention is now drawn to the skate frame 20. The frame 20 is preferably configured as an inverted, substantially U-shaped elongate member. The spine of the frame 20 defines a shoe mounting portion 50 and the downwardly depending sides thereof defined first and second sidewalls 52 and 53. The first and second sidewalls 52 and 53 are held in spaced parallel disposition by the shoe mounting portion 50, such that a plurality of longitudinally aligned wheels 24 is receivable between the lower ends of the sidewalls 52 and 53. Although the frame 20 is illustrated as a single-piece frame having sidewalls integrally formed with the shoe mounting portion, other configurations, such as two- and three-piece frames, are also within the scope of the invention and are described in greater detail below.

The wheels 24 are conventional roller skate wheels well known in the art. Each wheel 24 has an elastomeric tire 54 mounted on a hub 56. Each wheel 24 is journaled on bearings and is rotatably fastened between the first and second sidewalls 52 and 53 on an axle bolt 58. The axle bolt 58 extends between laterally aligned first and second axle mounting holes 60 and 61 (FIG. 2) located in the lower ends of the first and second sidewalls 52 and 53. The axle bolt 58 also extends laterally through two rotary bearings (not shown) located in the hub 56 of each wheel 24. Preferably, the wheels 24 are journaled to the frame 20 in a longitudinally aligned arrangement and are positioned substantially midway between the lateral and medial sides of the shoe portion 22.

The base 32 of the shoe portion 22 may be rigidly fastened to the shoe mounting portion 50 of the frame 20 by well-known fasteners (not shown), such as bolts or rivets. The fasteners extend vertically through the toe and heel ends 34 and 36 of the base 32 and into corresponding holes extending vertically through the shoe mounting portion 50. Although it is preferred that the shoe portion 22 be rigidly fastened to the frame 20, other configurations, such as detachably or hingedly attaching the shoe portion to the skate frame, are also within the scope of the present invention.

The frame 20 includes an inner skin 62, core material 64, structural filler material 66, and an outer skin 68. Within the meaning of this specification, skins are used to designate layer or layers of material. The inner and outer skins 62 and 68 are preferably constructed in a manner well-known in the art from a lightweight and high strength material, such as a carbon fiber reinforced thermosetting polymer or a fiber reinforced thermoplastic. Preferably, the filler material 66 is also a lightweight and high strength material having structural properties, such as strength and stiffness, greater than the core material 64. In particular, the filler material 66 can be the same composite material used to construct the inner and outer skins 62 and 68, or the filler material 66 can be some other material that is more structural and dense than the core material 64. Thus, while the type of material used as filler material 66 is not important to the invention, it is important that the filler material 66 is more structural in terms of stiffness, density, and strength than the core material 64. Furthermore, although the preferred embodiment is illustrated and described as having a separate plug of filler material 66, other configurations, such as a frame without filler material, are also within the scope of the present invention and are described in greater detail below.

Still referring to FIGS. 1 and 2, core material 64 is disposed within the first and second sidewalls 52 and 53 by being sandwiched between the inner and outer skins 62 and 68 of both sidewalls 52 and 53. The core material 64 has an average density that is less than the skins 62 and 68 and the filler material 66. Preferably, the core material 64 is an unreinforced or reinforced polymer, such as a structural foam or a syntactic foam, or a natural material, such as wood. The core material 64 may also be a viscoelastic material. The core material 64 is substantially rectangular in configuration and is disposed within each sidewall 52 and 53, such that the length of the core material 64 is parallel to a longitudinal axis extending between the ends of the frame 20. The core material 64 is located a predetermined distance above the first and second axle mounting holes 60 and 61 of the first and second sidewalls 52 and 53. A plug of filler material 66 surrounds the axle mounting holes 60 and 61 and borders the lower end of the core material 64. As configured, the filler material 66 absorbs at least a portion of the loads associated with the axle bolt 58 (FIG. 1) received therein. Because filler material 66 surrounds the axle mounting holes 60 and 61, it eliminates direct contact between the axle bolt 58 and the core material 64, thereby minimizing the risk of damage to the core material 64 from the axle bolt 58.

Figure 3:
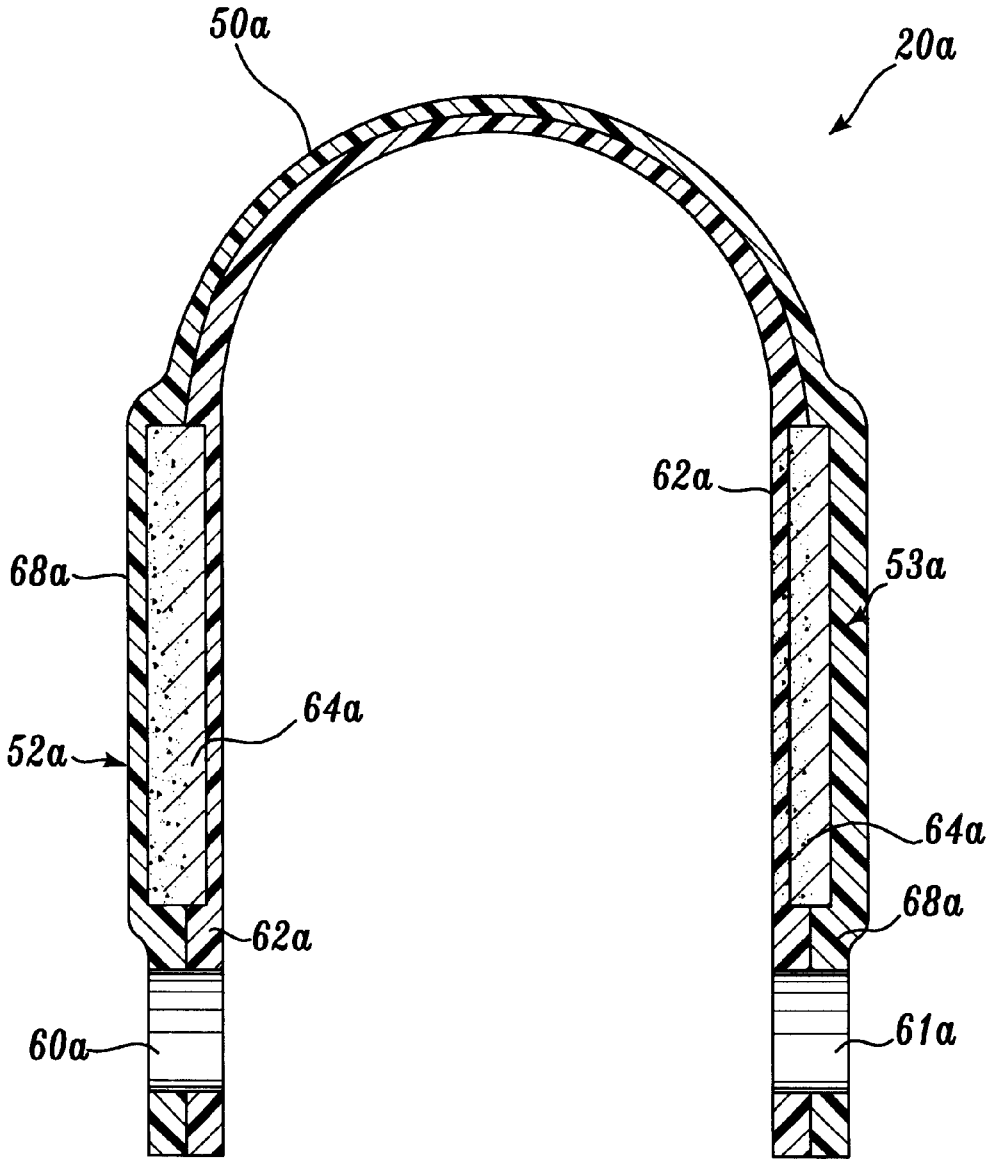
FIG. 3 is a cross-sectional end view of an alternate embodiment of an in-line skate frame constructed in accordance with the present invention showing the core material disposed between the inner and outer skins of the sidewalls.

Although it is preferred to have a plug of filler material 66 surrounding the axle mounting holes 60 and 61, other configurations are also within scope of the invention. As seen in the nonlimiting example of FIG. 3, the frame 20*a* may be constructed without filler material. The frame 20*a* is constructed in the same manner as described above for the preferred embodiment, with the exception that core material 64*a* is sealed within the first and second sidewalls 52 and 53 by the inner and outer skins 62*a* and 68*a*. The inner and outer skins 62*a* and 68*a* seal the core material 64*a* within the frame 20*a*, such that the skins 62*a* and 68*a* border all of the edges of the core material 64*a*. As configured, the skins 62*a* and 68*a* combine to surround the axle mounting holes 60*a* and 61*a*. Thus, although filler material is preferred, it is not necessary for the present invention.

As may be seen better by referring back to the preferred embodiment of FIG. 1, core material 64 extends nearly the length of the frame 20. The longitudinal ends of the core material 64 are sealed by the inner and outer skins 62 and 68, thereby avoiding structural failure or degradation of the core material 64 due to concentrated loads, abrasion and/or impact. Furthermore, as seen in FIG. 2, to limit damage to the core material 64 due to concentrated loads associated with the attachment of the shoe portion 22 to the frame 20, there is no core material 64 disposed within the shoe mounting portion 50. Thus, when the shoe portion 22 is attached to the shoe mounting portion 50 in the manner described above, there is no direct contact loading between the fasteners (not shown) attaching the shoe portion 22 to the frame 20 and the core material 64.

As configured, the risk of damage to the core material 64 from the shoe portion 22, the wheels 24 and direct exposure to the environment is minimized by utilizing an enclosed torsion box construction, wherein the core material 64 is sealed within the frame 20. Damage to the core material 64 is also minimized by removing core material from at least the load introduction portions of the frame 20, wherein loads associated with the wheels 24 and shoe portion 22 are transferred to the frame 20. Furthermore, because the core material 64 has a density that is less than that of either the filler material 66 or the material used to construct the inner and outer skins 62 and 68, and because it occupies a substantial volume within the sidewalls 52 and 53, the frame 20 is lighter than a comparable frame without the core.

Figure 4:
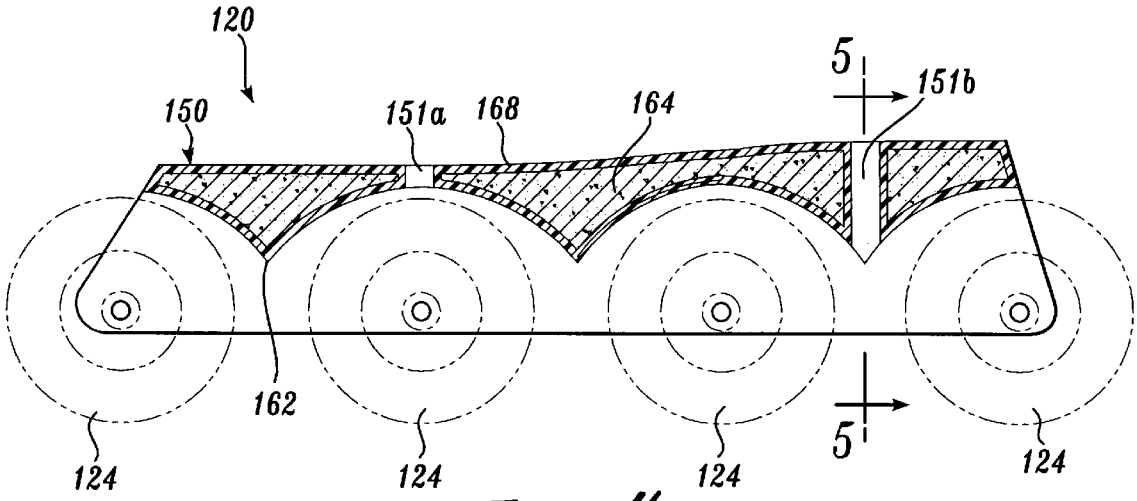
FIG. 4 is a cross-sectional side view through a second alternate embodiment of an in-line skate frame constructed in accordance with the present invention showing core material disposed within the shoe mounting portion of the skate frame.
Figure 5:
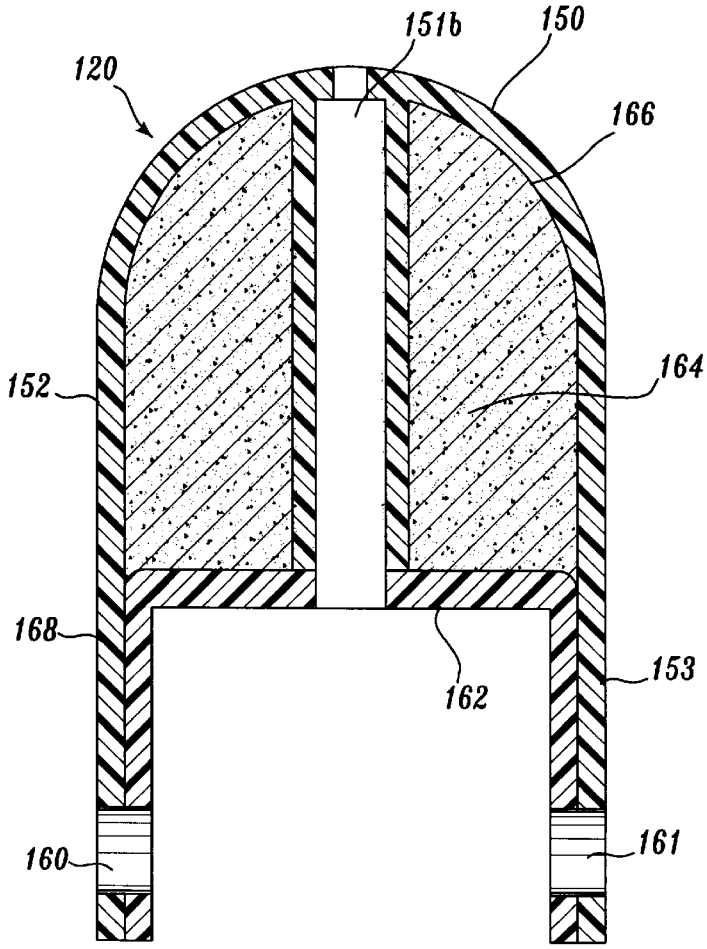
FIG. 5 is a cross-sectional end view of the second alternate embodiment of an in-line skate frame constructed in accordance with the present invention taken through Section 5—5 of FIG. 4 showing core material disposed within the shoe mounting portion of the skate frame.

Although it is preferred to dispose core material 64 within the first and second sidewalls 52 and 53 of a U-shaped frame, other locations of the core material 64 are also within the scope of the present invention. As seen in the first alternate embodiment of FIGS. 4 and 5, core material 164 may be located within the shoe mounting portion 150 of the frame 120. In this alternate embodiment, the frame 120 is constructed as described above for the preferred embodiment, except that core material 164 is now positioned between the inner and outer skins 162 and 168 of the shoe mounting portion 150 instead of being disposed within the sidewalls 152 and 153. As may be seen better in FIG. 5, core material 164 extends between the sidewalls 152 and 153, and is positioned above the wheels. Referring back to FIG. 4, the core material 164 contours the tops of the wheels 124 (shown in phantom), such that the core material 164, bounded along its lower edge by the skin 162, defines C-shaped wheel wells around the upper surface of each wheel 124.

As configured within the shoe mounting portion 150 of the skate frame 120, the core material 164 has a variable depth along the longitudinal direction of the skate frame 120. As seen better in FIG. 5, the core material 164 is not only positioned between the skins 162 and 168 of the shoe mounting portion 150, but the core material 164 also extends between the first and second sidewalls 152 and 153 of the frame 120.

Preferably, the upper shoe mounting portion 150 also includes a pair of vertically extending shoe attachment bores 151*a* and 151*b*. The shoe attachment bores 151*a* and 151*b* are each sized to receive a shoe attachment fastener (not shown) vertically therethrough. The fasteners are adapted to attach the toe and heel ends of the shoe portion 22 (FIG. 1) to the frame 120. Preferably, the edges of the core material 164 adjacent the attachment bores 151*a* and 151*b* are sealed within the shoe mounting portion 150 by the skins 162 and 168 to eliminate direct contact between the core material 164 and the shoe attachment fasteners. Thus, the core material 164 is sealed within the shoe mounting portion 150 by the skins 162 and 168.

Figure 6:
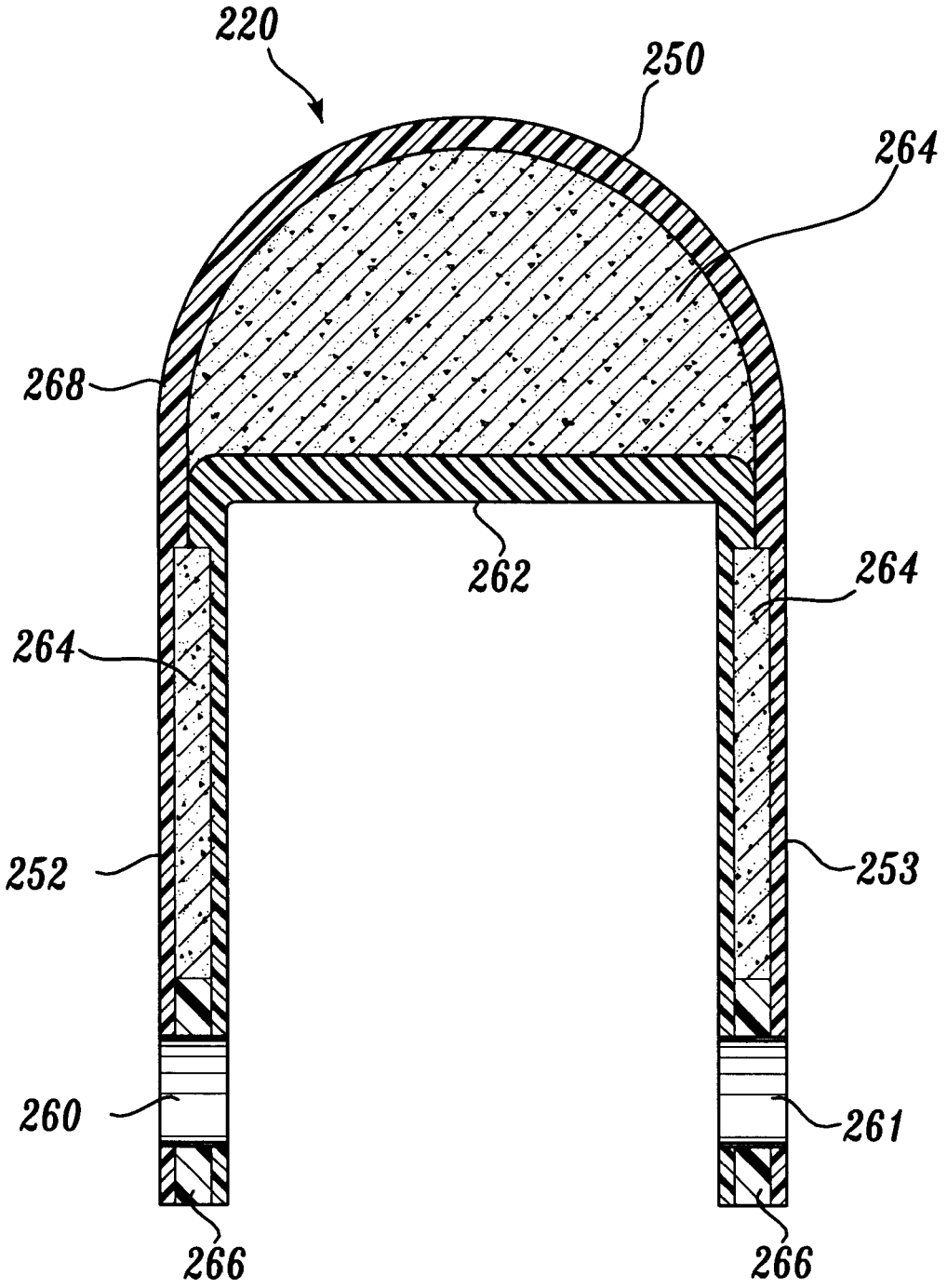
FIG. 6 is a cross-sectional end view of a third alternate embodiment of an in-line skate frame constructed in accordance with the present invention showing core material disposed between the inner and outer skins of both the sidewalls and shoe mounting portion of the skate frame.

As seen in the second alternate embodiment of FIG. 6, core material 264 may be located within multiple locations of the frame 220. In this alternate embodiment, the frame 220 is constructed as described above for the preferred embodiment and first alternate embodiment, except that core material 264 is now disposed between the skins 262 and 268 of both the shoe mounting portion 250 and the first and second sidewalls 252 and 253. The axle mounting holes 260 and 261 of this embodiment are surrounded by a plug of filler material 266 to eliminate direct contact between the core material 264 and the wheel axles (not shown). Thus, in this second alternate embodiment of the invention, core material 264 is located within both the shoe mounting portion 250 and the sidewalls 252 and 253, and is sealed therein by the skins 262 and 268 and/or the filler material 266.

Although a single piece frame having first and second sidewalls integrally formed with the shoe mounting portion is the preferred embodiment of the present invention, other configurations are also within the scope of the present invention. As seen in a first nonlimiting example of FIG. 7, the frame 320 may be a three-piece frame. The frame 320 is constructed the same as the preferred embodiment, except that the shoe mounting portion 350 and the first and second sidewalls 352 and 353 are all separate components of the frame 320. The sidewalls 352 and 353, having core material 364 sealed therein by the skins 362 and 368, are fastened to the shoe mounting portion 350 by screws, adhesive or in another manner well-known in the art. Preferably, the shoe mounting portion 350 is constructed from an aluminum or plastic material.

Figure 9:
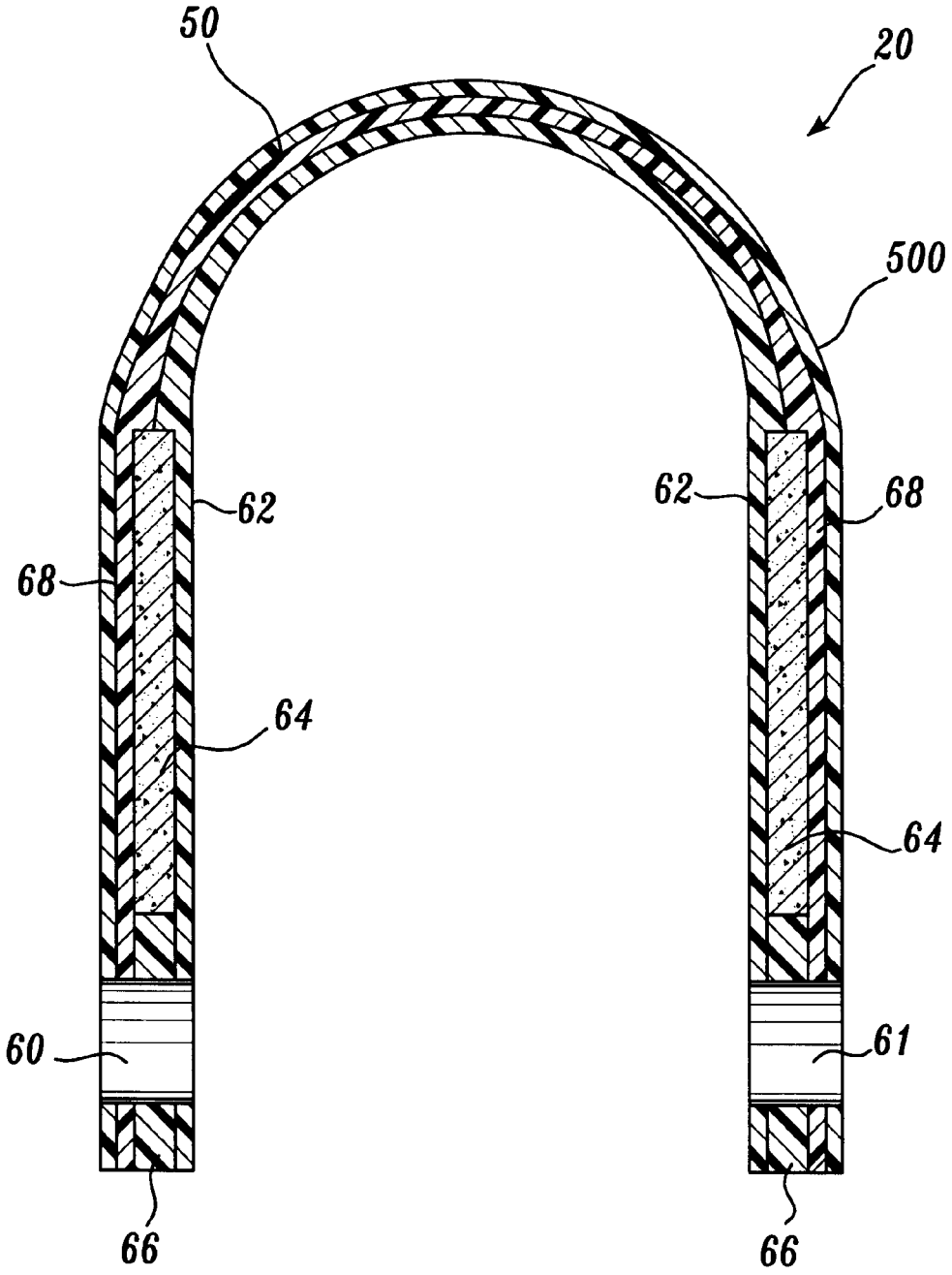
FIG. 9 is a cross-sectional end view through an in-line skate frame constructed in accordance with the present invention showing the core material disposed between the inner and outer skins of the sidewalls, a plug of filter material disposed around the wheel attachment bores, and a decorative sheet disposed on the outer skin.

As a second nonlimiting example, the frame 420 may be a two-piece frame. Referring to FIG. 8, each piece 490 and 492 of the frame 420 is configured as an inverted "L" and is preferably constructed from the same material as described above for the other example. The downwardly depending spine of each piece 490 and 492 defines the sidewalls 452 and 453. Core material 464 is sealed within each sidewall 452 and 453 in a manner described above for the preferred embodiment. Preferably, the core has a thickness contour, such that the external surface of the skate frame has a contour that reflects the contour of the core. Alternatively, and as seen in FIG. 9, each sidewall 452 and 453 has an inner and outer half 465 and 466. Each half may be stamped from a rigid material, such as aluminum, to define a contoured section. The contoured section is sized to receive the core material 464 therein, such that when the two halves 465 and 466 are joined together in a manner well known in the art, the core material 464 is disposed within the contoured sections of the inner and outer halves 465 and 466 of each sidewall 452 and 453. The base portions of each piece 490 and 492 project orthogonally from the sidewalls 452 and 453 and are adapted to be fastened together in a manner well-known in the art. As fastened, the base portions combine to define the shoe mounting portion 450.

In a preferred method of constructing a frame 20, core material 64 may be sealed within the sidewalls 52 and 53 of the frame 20. First, uncured inner skin composite material reinforced with fibers is laid up on a male mold until the desired thickness is achieved. The mold is substantially U-shaped in configuration. Then, core material 64 is disposed within the mold in the desired location. In the preferred embodiment, core material is disposed along the sides of the sidewalls of the inner skin. Although it is preferred that core material is positioned along the arms of the inner skin, core material may be disposed along other portions of the inner skin, such as along the arcuate portion or along both the arcuate portion and the arms of the inner skin.

Filler material 66 is then placed in the desired location within the mold. Uncured outer skin composite material is then applied to the mold, such that the core material and filler material are sandwiched between the inner and outer skins. A female mold is placed over the lay-up and the entire lay-up is permitted to cure. Although a plug of filler material is preferred, other configurations, such as eliminating the plug of filler material and laying the inner and outer skins to seal the core material therein, are also within the scope of the method of the present invention.

An alternate method of constructing a frame 20 in accordance with the present invention is identical to the preferred method, as described above, with the following exceptions. In place of the outer skin composite material, a decorative sheet 500 may be applied to the mold, such that the core material and the filler material are sandwiched between the inner skin and the decorative sheet 500. In still yet another alternate method of constructing a frame in accordance with the present invention includes the steps as outlined above for the preferred method with the following exception. As seen in FIG. 9, after the outer skin composite material is applied to the mold, the decorative sheet 500 is applied to the outer skin, such that the core material and filler material are sandwiched between the inner and outer skins, with a decorative sheet 500 disposed on the outer skin.

The previously described versions of the present invention have several advantages over skate frames currently available in the art. The skate frame of the present invention is lighter than solid composite or aluminum frames because a lightweight core material occupies a substantial volume within the frame. Also, because the core material is lightweight and has moderate structural properties in terms of strength and stiffness, the strength-to-weight ratio of the frame is increased. Further, because the skate frame of the present invention utilizes a core material that is less expensive than the reinforced composite material it replaces, it is more cost efficient than skate frames having an all composite construction. Finally, because core material is removed from the load introduction points associated with the wheels and shoe portion, the skate frame has a longer useful life than skate frames having a core that is in direct contact with the load introduction points. Thus, a skate frame constructed in accordance with the present invention has an increased strength-to-weight ratio and is less expensive than those currently available in the art.

From the foregoing description, it may be seen that the skate of the present invention incorporates many novel features and offers significant advantages over the prior art. It will be apparent to those of ordinary skill that the embodiments of the invention illustrated and described herein are exemplary only and, therefore, changes may be made to the foregoing embodiments. As a nonlimiting example, core material located within the sidewalls or upper surface of the skate frame may bulge outwardly, such that the sidewalls have a bubble contour to accommodate the core. Thus, it may be appreciated that various changes can be made to the preferred embodiment of the invention without departing from the spirit and scope of the invention.

The embodiments of the invention in which an exclusive property or privilege is claimed are defined as follows:

1. A skate frame for an in-line skate, the skate having a shoe portion and a plurality of wheels capable of traversing a surface, the skate frame comprising:

(a) an elongate structural member comprised of a structural material having a first average density, the structural member having a forward end, a rear end, an inner surface, an outer surface, first and second sidewalls each having an upper end and a lower end, and a shoe mounting portion spanning between the upper ends of the sidewalls, the lower ends of the first and second sidewalls being space to receive the wheels therebetween such that there is a gap extending along a longitudinal axis defined between the forward and rear ends of the structural member, the gap being defined between the inner and outer surfaces of the shoe mounting portion, the shoe mounting portion having a shoe load introduction portion; and (b) core material disposed within the gap and extending between the first and second sidewalls, the core material being absent from areas immediately adjacent at least the shoe load introduction portion.

2. The skate frame of claim 1, wherein the core material is an unreinforced material having a second average density that is less than the density of the structural material member.

3. The skate frame of claim 2, wherein the core material comprises a structural material selected from a group consisting of reinforced polymers, unreinforced polymers, viscoelastic material, and naturally fibrous or cellular materials.

4. The skate frame of claim 3, wherein the core material has a varying height along a longitudinal axis extending between the forward and rear ends of the frame.

* * * * *